US005214867A

United States Patent [19]

Weatherly et al.

[11] Patent Number: 5,214,867

[45] Date of Patent: Jun. 1, 1993

[54] FOREST FIRE EXTINGUISHING APPARATUS

[76] Inventors: Ervin E. Weatherly, 1821 Pheasant Rd., Sumter, S.C. 29153; Robert K. Willms, 208 Ocean Blvd., Isle of Palms, S.C. 29451

[21] Appl. No.: 881,183

[22] Filed: May 11, 1992

[51] Int. Cl.[5] ..... E02F 5/06

[52] U.S. Cl. ..... 37/357; 37/91; 37/94; 37/189; 37/462

[58] Field of Search ..... 37/9, 4, 83, 85, 86, 37/87, 91, 94, 189, 191 R, 192 R

[56] References Cited

U.S. PATENT DOCUMENTS

| | | | |
|---|---|---|---|
| 459,649 | 9/1891 | Reese | 37/87 X |
| 3,187,915 | 6/1965 | Spalding | 37/4 X |
| 3,982,688 | 9/1976 | Taylor | 37/85 X |
| 4,267,652 | 5/1981 | Senesac | 37/189 X |
| 4,993,498 | 2/1991 | Fresnel | 37/4 X |

*Primary Examiner*—Randolph A. Reese

*Assistant Examiner*—J. Russell McBee

*Attorney, Agent, or Firm*—Michael A. Mann

[57] ABSTRACT

Towed apparatus for excavating, pulverizing, and throwing soil to halt the spread of a forest fire. The apparatus comprises two series of rotating disks mounted to a first frame, each series driven by an hydraulic motor, for loosening the soil and pulverizing it into soil particles, followed by plowshares for funneling the resulting soil particles into a mound directly in the path of a spinner rotatably secured within a housing and having a plurality of fins attached thereto that scoop portions of the soil particles from the mound and throw them through a hole in the housing. Each disk in the series of disks has teeth secured about its peripheral edge for loosening the soil, pulverizing it and cutting and grinding roots, stumps and friable rock. The first frame is connected to a wheeled second frame by hydraulic cylinders to raise and lower the first frame with respect to the soil so that the series of disks can engage and be disengaged the soil to the depth desired.

14 Claims, 4 Drawing Sheets

TO HYDRAULIC MOTOR

FOREST FIRE EXTINGUISHING APPARATUS

BACKGROUND OF THE INVENTION

1. Field of the Invention

The present invention relates to apparatus for fighting forest fires. More specifically, the present invention comprises an apparatus for pulverizing and hurling soil to stop the spread of a forest fire.

2. Discussion of Background

Uncontrolled forest fires can destroy large tracts of standing timber and thereby affect wildlife, the atmosphere, soil and water conservation, residential homes located in areas in the path of the fire and human life. Fighting forest fires in remote areas can be especially difficult logistically when roads are few and water is unavailable or insufficient.

Fire breaks have long been used to establish a gap between adjacent sections of a forest so that, if one section is consumed by fire, the adjacent section might be spared by the inability of the fire in the first section to cross the break.

Fires can be put out with a number of materials, including water, fire-retarding chemicals, and dirt. Dirt snuffs out the fire when applied to fallen trees, branches, grasses. Dirt, being generally free of dry fuels itself, can halt the spread of a fire in much the same manner as a fire break. Dirt is also readily available in and near forests.

There are several apparatus for use in fighting forest fires that excavate a quantity of dirt and throw it toward the path of the fire. In U.S. Pat. No. 4,852,656 Banahan discloses an apparatus that uses beaters between and coaxial with disks to cut and pulverize dirt and hurl it through a guide chute. Hurlbert, in U.S. Pat. No. 2,561,701, describes an apparatus that uses scrapers to loosen and a rotary brush to sweep up dirt and dust for blowing on a grass fire through a spout. French patent 88-093642/14 issued to Gerard is for an apparatus that cuts a trench in the ground. His self-propelled apparatus has scrapers and a conduit for blowing the dirt loosened and pulverized by a cutter chain and a grinder to the side.

There remains a need for a device for excavating a trench large enough to provide sufficient dirt for fighting fires and for pulverizing and hurling the excavated dirt as directed.

SUMMARY OF THE INVENTION

According to its major aspects and broadly stated, the present invention is an apparatus for excavating soil to use in stopping the spread of fires. The apparatus is made to be towed behind a tracked vehicle but may also be self-propelled. It excavates a quantity of dirt as it moves along, leaving a shallow trench, and throws the dirt to one side of the apparatus.

The apparatus comprises two frames, one with ground-engaging wheels and a second frame supported from the first by hydraulic cylinders so that it can be raised or lowered with respect to the first. The second frame is raised when the apparatus is not in use and is lowered for excavating to the depth necessary to produce the quantity of soil particles needed to thwart the fire.

On an axle carried by the second frame is a series of disks. Preferably, two separate axles are carried by the second frame, each one having a disk series. Each disk has teeth attached to it about its circumference that will pulverize the soil and cut and grind roots, stumps and friable rock into small particles. As the apparatus moves, the loosened soil particles formed by the series of disks are funneled into a mound or windrow by one or more plowshares. Behind the plowshares is a housing with a rotating spinner inside and directly in the path of the mound of particles. Fins attached to the periphery of the spinner throw the particles through holes in the top of the housing to either side of the apparatus, as desired.

The cooperation between the housing and the spinner is an important part of the present invention. The spinner will propel a major portion of the soil particles funneled to it through one of the holes in the housing, each fin scooping a portion of the soil particles as the spinner rotates. This cooperation assures that the soil particles are directed to the desired side of the apparatus and are thrown a sufficient distance.

The cooperation of the spinner and the plowshares is another important feature of the present invention. The plowshares funnel or channel the soil particles into a mound directly in the path of the spinner, enabling a major portion of the particles to be expelled from the housing. Using plowshares causes the inward folding of the particles from the sides of the apparatus. Furthermore, plowshares are readily available and easily replaceable when worn.

The series of disks are another feature of the present invention. By ganging the disks in one or two series, the soil, which includes not only dirt but pieces of wood, stumps, and friable rock, will be pulverized into small, mostly uniform soil particles, free of clumps of dirt. The finer and more uniform the soil particles formed, the easier it is to disperse them and the better the dispersion pattern.

Still another important feature of the present invention is the use of two frames and a set of hydraulic cylinders to change the elevation of one frame with respect to the other. The second frame, which carries the series of disks can be raised to disengage the disks from the soil and lowered to engage the soil.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figures 1, 2:
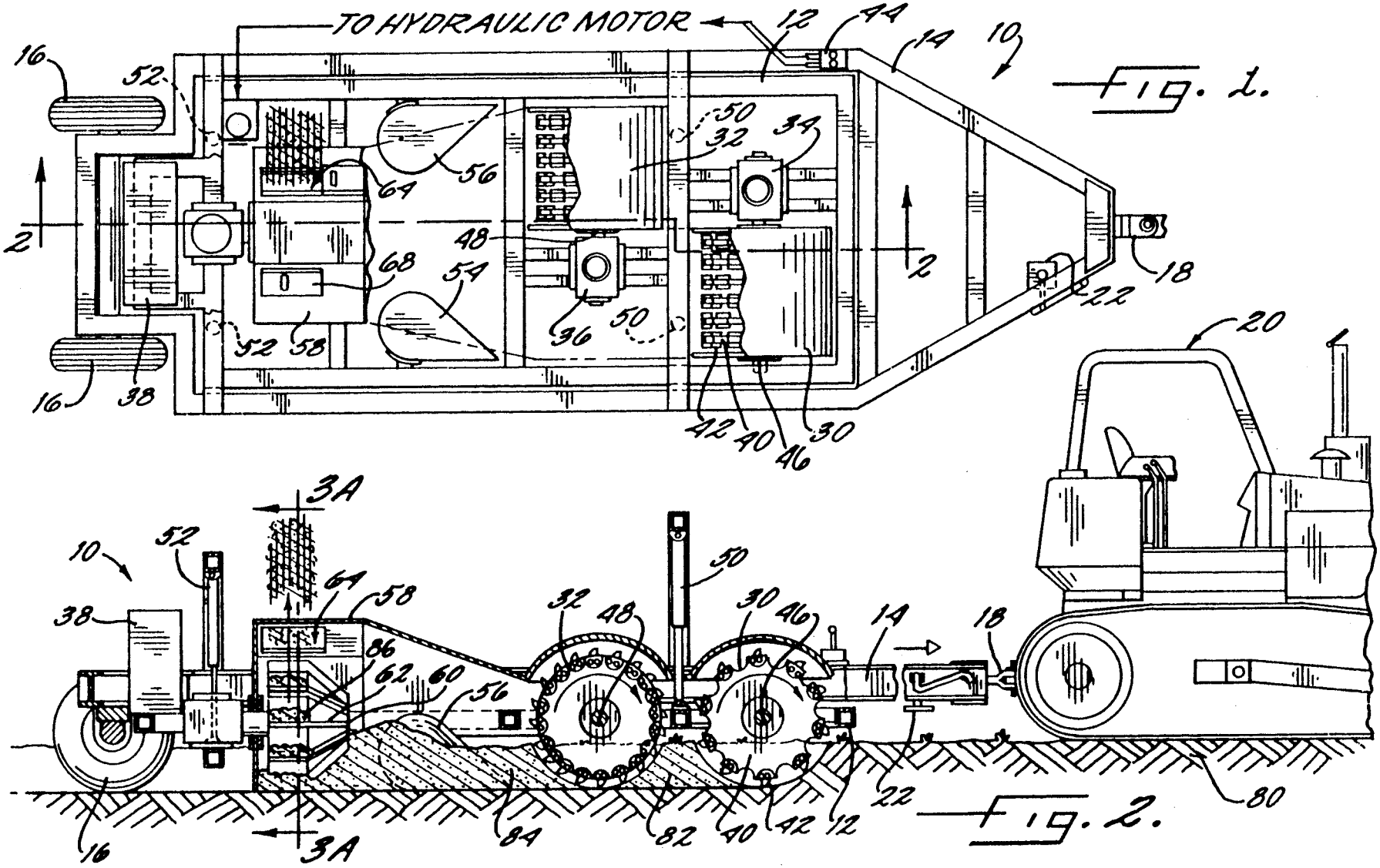
FIG. 1 is a top plan view, partially cut away, of an apparatus according to a preferred embodiment of the present invention.
FIG. 2 is a side cross sectional view of the apparatus shown in FIG. 1 taken along line 2—2.

Referring now to FIGS. 1 and 2, an apparatus according to a preferred embodiment of the present invention is shown as indicated generally by reference character 10. Apparatus 10 has a first frame 12 and a second frame 14. A pair of ground-engaging wheels 16 are rotatably carried by second frame toward the rear of apparatus 10, and a hitch 18, preferably an I-type hook hitch, is formed toward the front of apparatus 10 so that it can be pulled by a tracked vehicle 20, preferably a bulldozer, such as a 750 John-Deere Crawler-Dozer. When not attached to a tracked vehicle 20, a stand 22 near hitch 18 can be lowered to keep apparatus 10 level and stable. Alternatively, apparatus 10 can be made to be self-propelled by suitable modifications as would be known to someone of ordinary skill in the art.

Apparatus 10 is shown with two series of disks off-set from each other, a first series 30 and a second series 32. Each series has its own hydraulic motor, 34, 36, respectively. Hydraulic motors 34, 36 are operated by an engine 38, preferably a diesel engine with an hydraulic pump, toward the rear of apparatus 10. Each series 30, 32, is comprised of a plurality of disks 40 having teeth 42 attached about their circumferences in a manner to be described more fully below. First and second series 30, 32, are each attached to an axle 46, 48 rotatably carried by first frame 12.

First and second frames 12, 14, are interconnected by a first pair of hydraulic cylinders 50 toward the rear of apparatus 10. A second pair of hydraulic cylinders 52 is positioned just past midway toward the front of apparatus 10. First and second pairs 50, 52 allow the relative elevation of first frame 12 with respect to second frame 14 to be changed as will be described more fully below.

Following first and second series of disks 30, 32, are two plowshares 54, 56 carried by first frame 12. Immediately behind plowshares 54, 56, is a housing 58 that encloses a spinner 60. Spinner 60 is generally cone-shaped and rotatably carried by second frame 12 so that it spins about an axis parallel to the direction of travel of apparatus 10 with the point of the cone directed forward. Engine 38 turns spinner 60 on its axis. Attached about the periphery of spinner 60 are a plurality of fins 62. Above spinner 60, in the top of housing 58, are two openings 64 and 66. A first lid covers opening 66; opening 64 is shown uncovered. Housing 58 preferably extends forward over plowshares 54, 56 and disk series 30, 32 so that soil particles thrown upwardly by teeth 42 are confined.

Figure 3A:
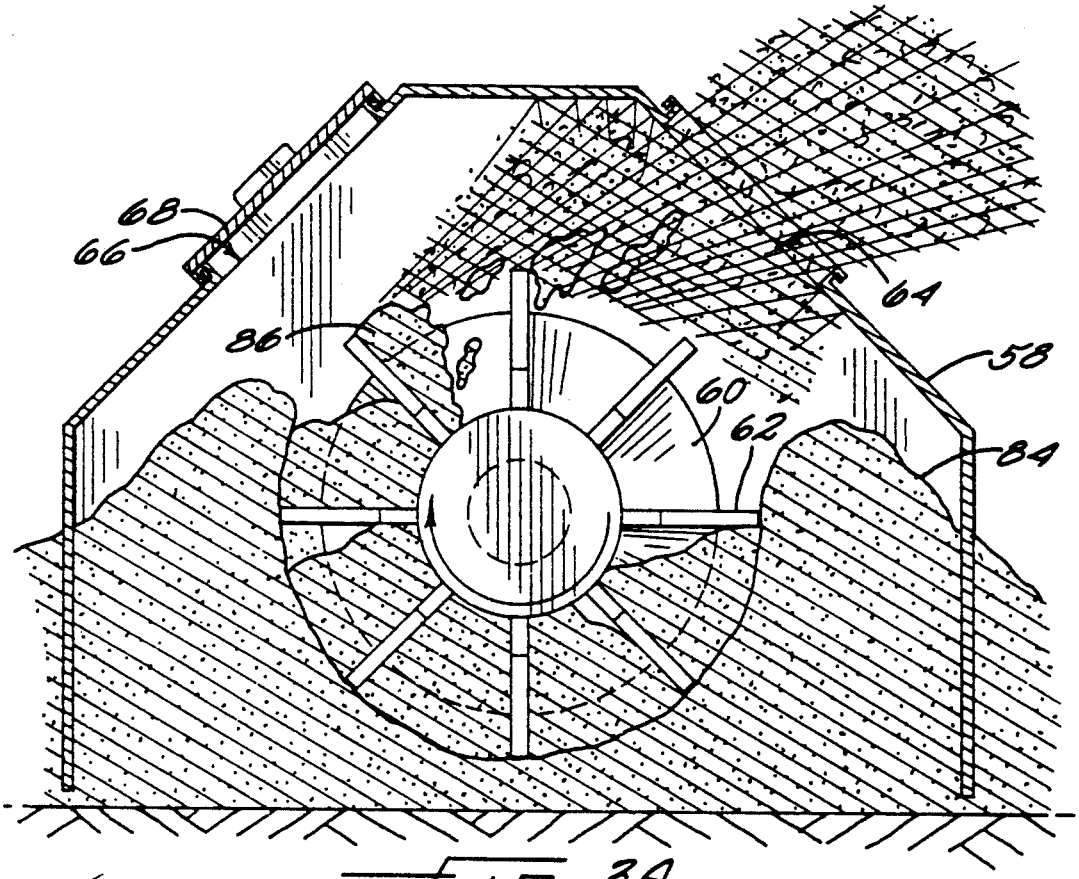
FIG. 3*a* is a cross sectional view of the apparatus shown in FIG. 2 taken along lines 3—3 throwing soil particles through an opening in the housing.
Figure 3B:
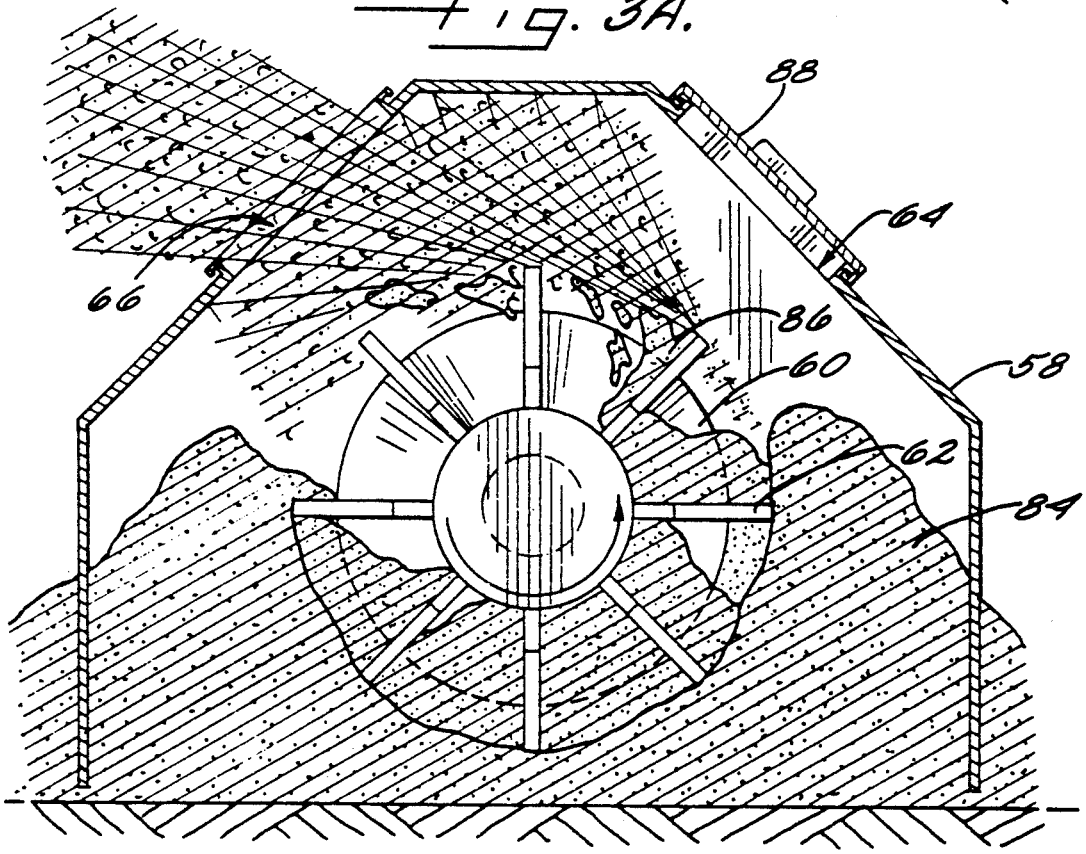
FIG. 3*b* is a cross sectional view of the apparatus of FIG. 2 showing soil particles being propelled through a different opening in the housing.

As apparatus 10 is pulled and when first and second series of disks 30, 32 are rotated by hydraulic motors 34, 36, the soil 80 over which apparatus 10 is pulled is loosened and pulverized into particles 82, the teeth 42 cutting into soil 80, and through roots, stumps and friable rock. Pulverized soil particles 82, which include pieces of roots, stumps and rock, are funneled by plowshares 54, 56, folding soil particles 82 from the sides of apparatus 10 toward its center to form a mound 84 or windrow directly in the path of spinner 60 as apparatus 10 is towed. Fins 62 on spinner 60 pick up portions 86 of soil particles 82 from mound 84 and throw them through opening 64 (FIG. 3a) to the exterior of housing 58 in a desired, preselected direction. If first lid 68 is removed and a second lid 88 is placed over opening 64, then soil particles 82 are thrown through opening 66. It will be clear that additional openings can be formed in housing 58, including, for example, openings to the rear of apparatus 10 or a pivotable chute could be provided as is found in snowblowing equipment to provide further control over the direction soil particles 82 are thrown.

Figure 4:
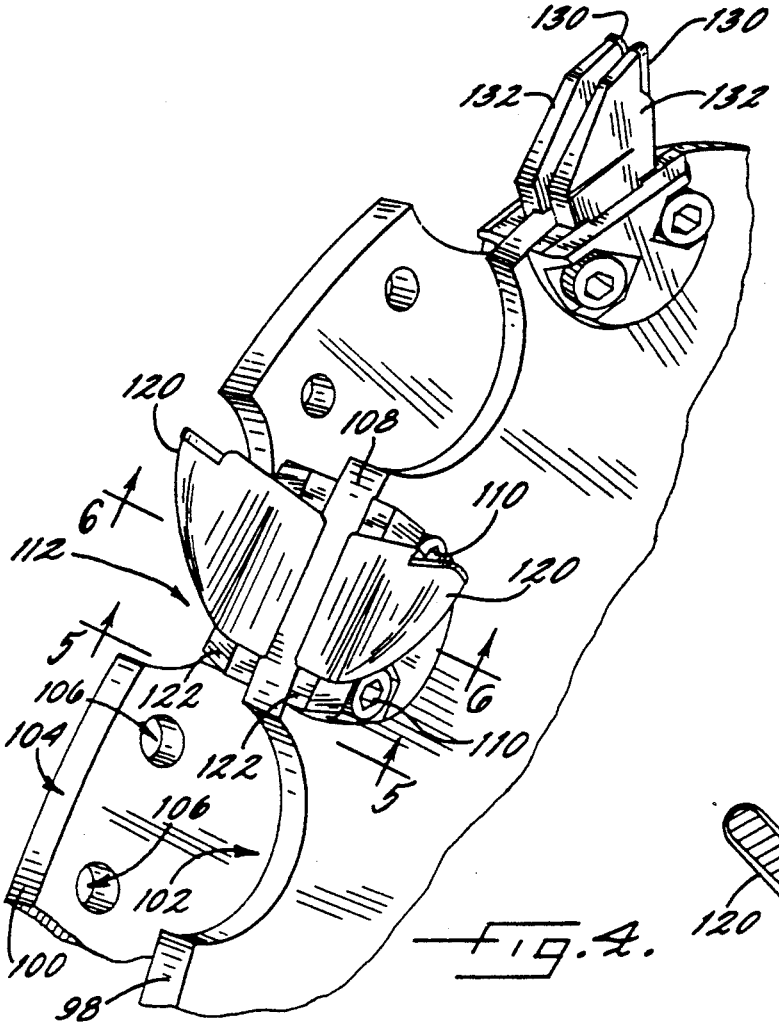
FIG. 4 is a detailed, perspective view of two adjacent disks.
Figure 7:
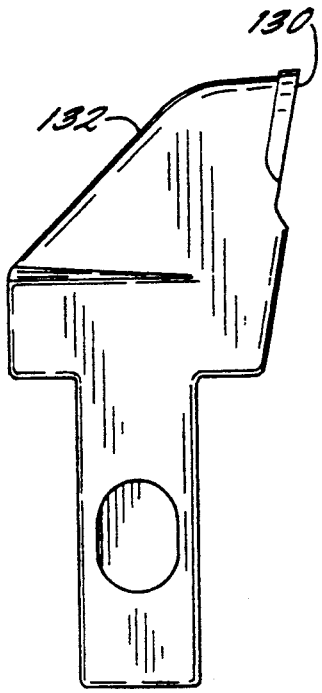
FIG. 7 is a side view of a second type of tooth.
Figure 6:
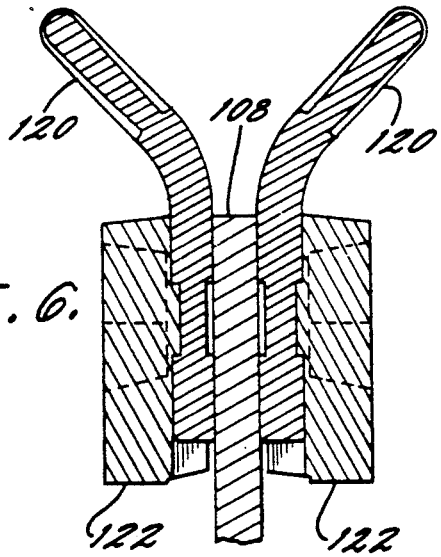
FIG. 6 is an assembled, cross sectional view showing the attachment of the teeth carried by the disk of FIG. 4 taken along line 6—6.
Figure 5:
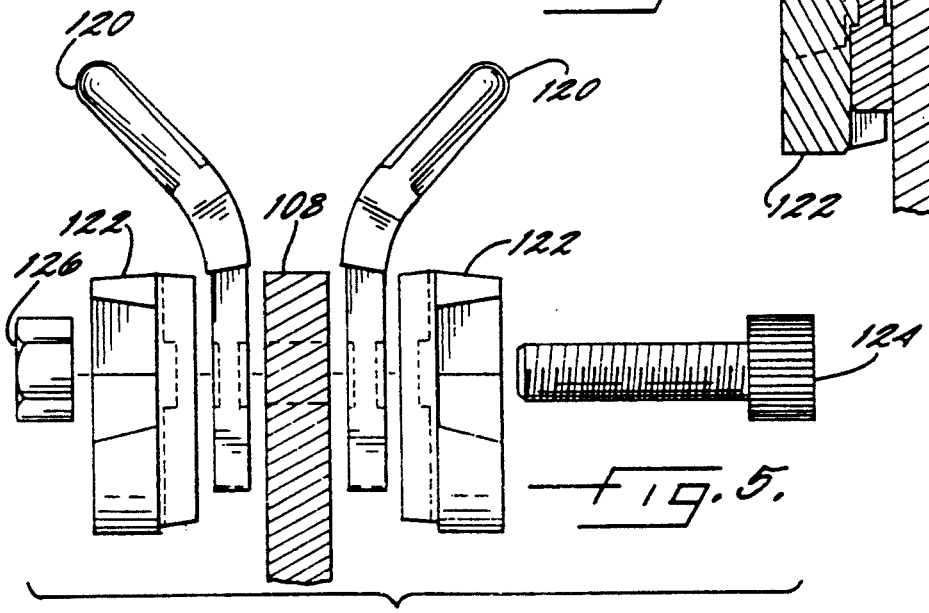
FIG. 5 is an exploded, cross sectional view showing the attachment of one type of tooth carried by the disk of FIG. 4 taken along line 5—5.
Figure 8:
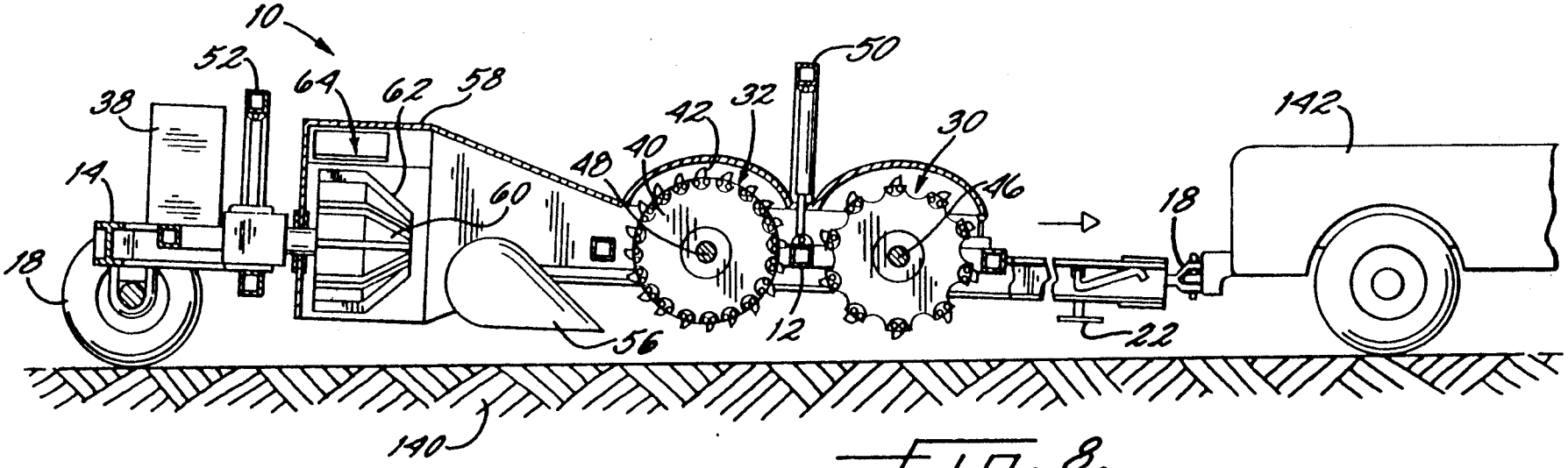
FIG. 8 is a side, cross sectional view of the apparatus shown with the second frame in an elevated condition, the disks disengaged from the soil, according to a preferred embodiment of the invention.

The specific, preferred structure of a disk and teeth are illustrated in FIGS. 4–7. In FIG. 4, two adjacent disks 98, 100 are shown. Each disk has a cutout portion followed by a portion with two bolt holes. Adjacent disks 98, 100 are staggered; that is, a cutout portion 102 of disk 98 is adjacent a portion 104 with two bolt holes 106 of disk 100 and a portion 108 having two bolt holes 110 on disk 98 is adjacent a cutout portion 112 of disk 100.

Each disk has preferably ten portions 104, 108 about its periphery. At eight portions 104, 108 of the ten on disks 98, 100, are bolted two teeth 120, of the type illustrated in FIG. 5. Each tooth 120 flares outwardly and is held in place by a mounting plate 122, with a bolt 124 and nut 126 securing two opposing teeth 120 and their respective two mounting plates 122 to disk 98. At the remaining two portions 104, 108 of ten on disks 98, 100, a tooth 132, of the type illustrated from the side in FIG. 7, without the flare and having a cutting edge 130 oriented to face the direction of rotation of disk 128. Teeth 132 are mounted 180° apart on disks 98, 100.

When apparatus 10 is to be moved over the road and is not engaged in excavation of soil, first frame 12 can be raised with respect to second frame 14 to move first and second series of disks 30, 32, out of engagement with soil 140. First and second pair of hydraulic cylinders 50, 52 raise the two ends of first frame for hauling by a truck 142 for example.

In use, first and second series of disks 30, 32 are first rotated by hydraulic motors 34, 36. Then apparatus 10 is moved forward slowly by tractor 20. The first frame 12 is lowered with respect to second frame 14 so that disks 40 engage and dig into soil 140. Disks 40 are lowered to a depth sufficient to pulverize enough soil 140 for throwing to the exterior of apparatus 10 to halt the spread of the fire, such as, for example, a depth of twelve inches, leaving a shallow trench approximately eight feet wide and throwing over 120 cubic yards of soil per minute when moving five miles per hour. As apparatus 10 moves, plowshares 54, 56, funnel soil particles 82 into a mound 84 so that fins 62 on spinner 60 can throw portions 86 of soil particles 82 through opening 64.

The controls (not shown) for apparatus 10 are all remotely located in the towing vehicle. These controls include a starter for engine 38, a throttle, a kill switch, and controls for the first and second sets of hydraulic cylinder pairs 50, 52, and operation of first and second hydraulic motors 34, 36, which would preferably have preset RPM limits.

In one embodiment, disks 40 are preferably 30 inches in diameter, eight to a series, four inches between teeth. On each disk 40 teeth flare to just under four inches apart, cutting edge to cutting edge.

It will be apparent to those skilled in the art that many changes and substitutions can be made to the preferred embodiment herein described without departing from the spirit and scope of the present invention. Clearly, for example, additional series of disks could be used to cut a wider trench, or with a larger hydraulic motors; one series could be used rather than two. Furthermore, devices other than plowshares exist to funnel soil particles. Plowshares are aptly suited for this task, readily available and easily replaced when worn. However, the invention as described and illustrated by the foregoing detailed description of a preferred embodiment is as defined by the appended claims.

What is claimed is:

1. An apparatus for excavating soil to use in stopping the spread of fires, said apparatus comprising:

a first frame;

an axle rotatably carried by said first frame;

a series of disks, each disk of said series of disks attached to and rotating with said axle;

means carried by said each disk for forming loosened soil particles from said soil when said series of disks engage said soil and are rotated, said soil being pulverized by said forming means;

means in spaced relation to said forming means for throwing said soil particles from said apparatus, said throwing means having a housing carried by said first frame, a spinner located within said housing, said spinner being rotatable about an axis, means formed on said spinner for scooping portions of said soil particles and propelling said portions, and means formed in said housing for directing said portions of soil particles propelled from said spinner from said housing and exterior to said apparatus in a preselected direction, said funneling mean funneling said soil particles toward said spinner; and means between said forming means and said throwing means for funneling said soil particles toward said throwing means so that a major portion of said soil can be thrown.

2. The apparatus as recited in claim 1, wherein said funneling means further comprises a plowshare carried by said first frame, said plowshare being curved to fold said soil particles into a mound forward of said throwing means and in the path of said throwing means when said apparatus is moved with respect to said soil.

3. The apparatus as recited in claim 1, wherein said funneling means further comprises a plowshare carried by said first frame, said plowshare folding said soil particles into a mound forward of said spinner and in the path of said spinner when said apparatus is moved with respect to said soil.

4. The apparatus as recited in claim 1, wherein said apparatus further comprises:

a second frame carrying said first frame; and a set of soil engaging wheels rotatably carried by said second frame;

means carried by said second frame for elevating said first frame with respect to said second frame so that said first frame can be raised and lowered with respect to said soil.

5. An apparatus for excavating soil to use in stopping the spread of fires, said apparatus comprising:

a first frame;

a second frame carrying said first frame;

a set of soil engaging wheels rotatably carried by said second frame;

an axle rotatably carried by said first frame;

a series of disks, each disk of said series of disks attached to and rotating with said axle;

means carried by said each disk for forming loosened soil particles from said soil when said series of disks engage said soil and are rotated, said soil being pulverized by said forming means;

means in spaced relation to said forming means for throwing said soil particles from said apparatus, said throwing means having a housing carried by said first frame;

a spinner located within said housing, said spinner being rotatable about an axis;

means formed on said spinner for scooping portions of said soil particles and propelling said portions; and means formed in said housing for directing said portions of soil particles propelled from said spinner from said housing and exterior to said apparatus in a preselected direction; and means carried by said second frame for elevating said first frame with respect to said second frame so that said first frame can be raised or lowered with respect to said soil.

6. The apparatus as recited in claim 5, wherein said elevating means is at least one hydraulic cylinder connected between said first and said second frame so that the elevation of said second frame can be changed by said at least one hydraulic cylinder whereby said forming means carried by said second frame can be brought into engagement and out of engagement with said soil.

7. The apparatus as recited in claim 5, further comprising means for rotating said series of disks.

8. The apparatus as recited in claim 5, further comprising a plowshare carried by said first frame rearwardly of said series of disks, said plowshare being curved to fold said soil particles into a mound forward of said throwing means and in the path of said throwing means when said apparatus is moved with respect to said soil.

9. An apparatus for excavating soil to use in stopping the spread of fires, said apparatus comprising:

a first frame;

a second frame;

means interconnecting said first frame and said second frame for elevating said first frame with respect to said second frame;

a set of soil engaging wheels rotatably carried by said second frame;

two axles rotatably carried by said first frame;

two series of disks, each of said series of disks attached to and rotating with one of said axles;

means carried by said each disk for forming loosened soil particles from said soil when said series of disks engage said soil and are rotated, said soil being pulverized by said forming means;

two plowshares positioned rearwardly of said series of disks, said plowshares funneling said soil particles into a mound when said apparatus is moved relative to said soil; and means in spaced relation to said forming means for throwing a major portion of said mound of soil particles from said apparatus.

10. The apparatus as recited in claim 9, wherein said throwing means further comprises:

a housing carried by said first frame;

a spinner located within said housing, said spinner being rotatable about an axis;

means formed on said spinner for scooping portions of said mound of soil particles and propelling said portions; and means formed in said housing for directing said portions of soil particles propelled from said spinner from said housing and exterior to said apparatus in a preselected direction.

11. The apparatus as recited in claim 9, wherein said throwing means further comprises:

a housing carried by said first frame, said housing having at least one opening;

a spinner located within said housing, said spinner being rotatable about an axis;

a plurality of fins attached to said spinner and extending radially from said spinner for scooping portions of said mound of soil particles and propelling said portions; and at least one lid for covering said at least one opening of said housing, said opening, when said lid is removed therefrom allowing said portions of soil particles to be propelled by said spinner from said housing.

12. The apparatus as recited in claim 9, further comprising means for rotating said two series of disks.

13. The apparatus as recited in claim 9, further comprising a power source, said power source rotating said disks and moving said apparatus.

14. The apparatus as recited in claim 9, wherein said elevating means further comprises at least one hydraulic cylinder interconnecting said first and said second frames, said hydraulic cylinder adapted to change the elevation of said second frame with respect to said first frame so that said two series of disks can be brought into and out of engagement with said soil.

* * * * *